United States Patent [19]

Witczak et al.

[11] Patent Number: 4,682,543

[45] Date of Patent: Jul. 28, 1987

[54] INK OR MOISTURE ROLLER FOR DUPLICATING MACHINES

[75] Inventors: Stanley Witczak, Chicago; Earl L. Gasner, Schaumberg, both of Ill.

[73] Assignee: AM International, Inc., Chicago, Ill.

[21] Appl. No.: 806,793

[22] Filed: Dec. 9, 1985

[51] Int. Cl.[4] ..... B41F 31/06; B41F 31/26

[52] U.S. Cl. ..... 101/350

[58] Field of Search ..... 101/348, 349, 350, 363, 101/148; 29/121.1, 121.6, 121.5, 125

[56] References Cited

U.S. PATENT DOCUMENTS

| | | | |
|---|---|---|---|
| 1,207,259 | 12/1916 | Wood | 101/350 |
| 2,213,419 | 9/1940 | Taylor | 101/350 |
| 2,369,814 | 2/1945 | Worthington | 101/350 |
| 2,393,529 | 1/1946 | Harrigan | 118/262 |
| 2,406,928 | 9/1946 | Taylor et al. | 101/350 |
| 2,519,229 | 8/1950 | Crafts | 101/350 |
| 2,580,667 | 1/1952 | Kaeber et al. | 101/350 X |
| 2,996,981 | 8/1961 | Reinartz et al. | 101/148 |
| 3,084,663 | 4/1963 | Warner | 101/350 |
| 3,098,437 | 7/1963 | Tyma, Jr. et al. | 101/350 |
| 3,417,692 | 12/1968 | Brodie | 101/350 |
| 3,651,757 | 3/1972 | Gowin | 101/350 |
| 3,910,186 | 10/1975 | D'Amato | 101/350 |
| 4,301,583 | 11/1981 | Poole | 29/121.2 |
| 4,301,730 | 11/1981 | Heurich et al. | 101/348 |
| 4,399,751 | 8/1983 | Kessler | 101/348 |

*Primary Examiner*—J. Reed Fisher

*Attorney, Agent, or Firm*—Nicholas A. Camasto; John R. Hoffman

[57] ABSTRACT

An ink or moisture pickup roller for feeding ink or moisture from a reservoir or fountain roller to a transfer roller. The surface of the pickup roller is formed by a plurality of spaced circular ribs defining a pattern of generally parallel ridges and valleys along the roller normal to the axis of the roller.

5 Claims, 4 Drawing Figures

FIG. 3
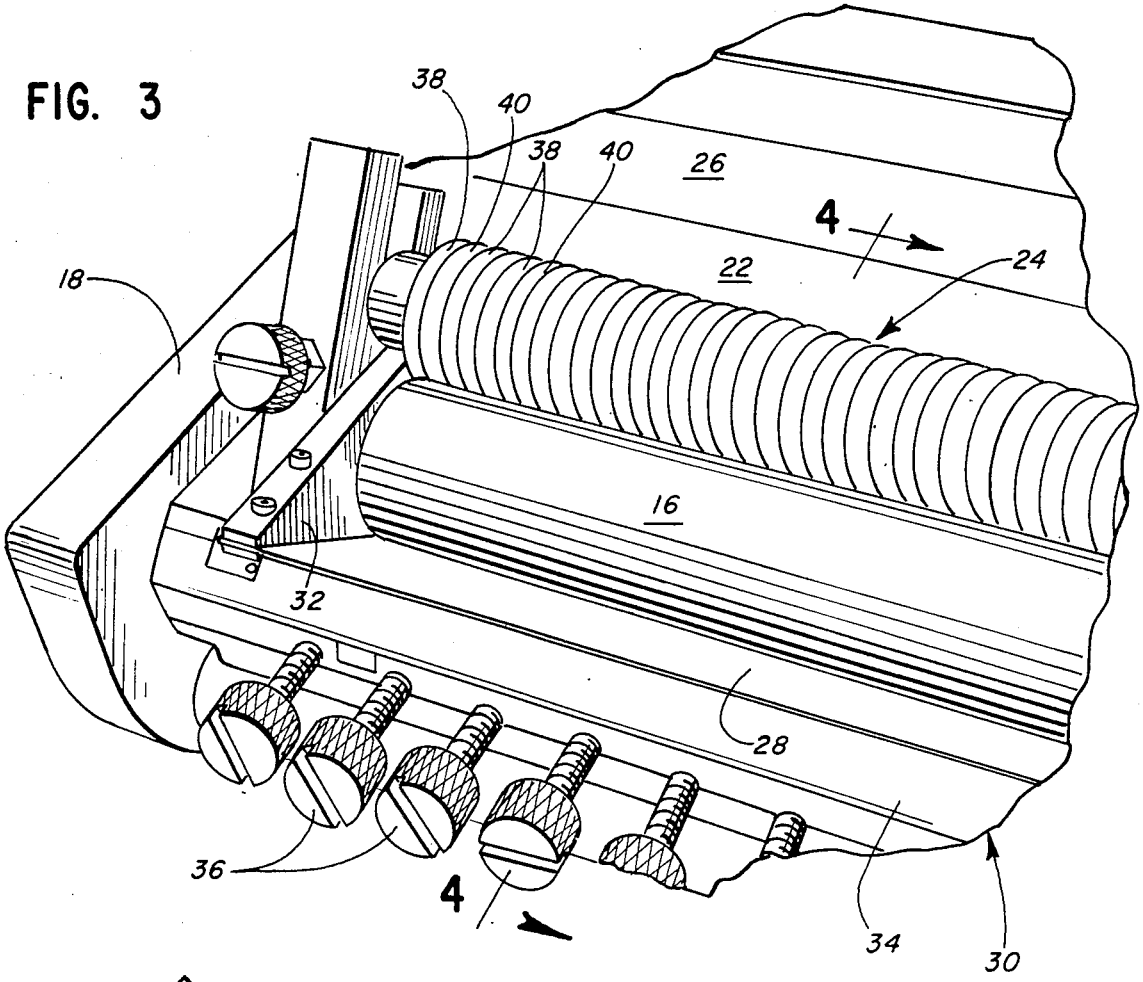
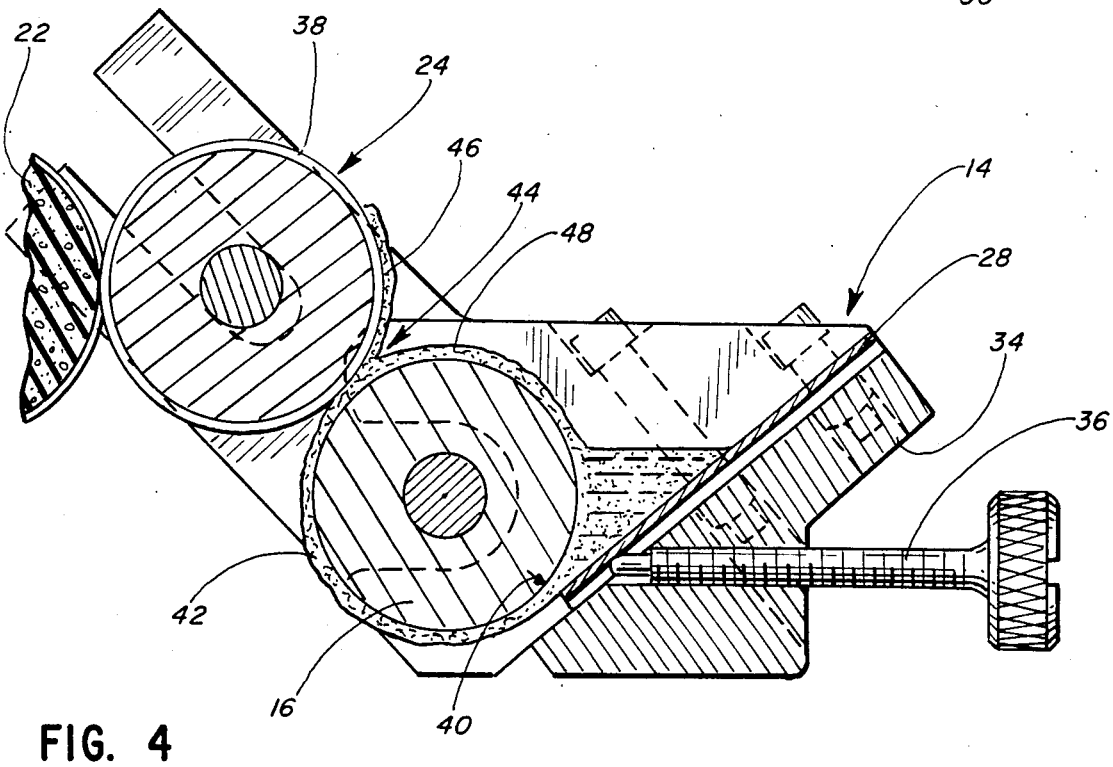
FIG. 4

INK OR MOISTURE ROLLER FOR DUPLICATING MACHINES

BACKGROUND OF THE INVENTION

This invention relates generally to duplicating machines and, more particularly, to an ink or moisture feeding system including an improved ink or moisture pickup roller.

Printing machines, such as rotary offset lithographic duplicating machines, rotary printing presses, or the like normally include a printing couple which comprises a number of cylinders and/or rollers for supplying ink from a reservoir. In offset lithographic machines, moisture also is supplied from a reservoir. A fountain for the ink or moisture is provided for feeding ink, for instance, to the various rollers of the printing couple which transfers images to copy sheets.

Conventional ink fountain assemblies normally take the form of a fountain trough defined by an elongated blade extending along one side and an ink fountain roller extending along the opposite side of the trough. The ink fountain roller transfers the ink to a pickup roller and other rollers of the printing couple to smooth out the ink film and carry it to a plate or printing cylinder which applies the ink in a desired pattern to the copy sheets or paper. The ink fountain blade is adjustable by a plurality of thumb screws to vary the gap between an edge of the blade and the ink fountain roller in order to maintain consistency in the amount of ink applied to the roller along the length of the roller.

The pickup roller conventionally comprises either a continuous contact roller or a ductor roller which oscillates back and forth to intermittently pick up ink from the fountain roller. It can be understood that the better the pickup roller is able to supply an even and uniform flow of ink, the less need there will be for spreading out and smoothing the ink film as it is carried to the plate or printing cylinder. Problems constantly are encountered in achieving such an even and uniform flow of ink to the printing couple. With continuous pickup rollers, having smooth surfaces, the thickness of the ink film on the fountain roller must be quite thin. Obviously, with such a thin film, there is a very small range to work with in adjusting the thickness of the film which is transferred by the pickup roller.

With conventional ductor rollers, problems constantly are encountered by shadows caused by ductor roller skidding and bouncing. Ductor rollers also require complicated and expensive ducting mechanisms.

In either a continuous contact roller system or a ductor roller system, it is widely known that a smooth surfaced pickup roller does not feed an even flow of ink to the inking system. A pattern of irregular ink blotches forms on a smooth surfaced pickup roller so that ink is not uniformly delivered for any given area of thumb screw adjustment and fountain blade setting.

Attempts have been made to provide a pickup roller with a non-smooth surface to better supply an even and uniform flow of ink to the inking system. For instance, the entire surface of the pickup roller has been formed with a pattern of projections, such as tiny pointed pyramids as shown in U.S. Pat. No. 2,213,419, issued Sept. 3, 1940, to Taylor. Not only is such a roller extremely expensive to manufacture, but the myriad of grooves and projections do not provide a sufficiently consistent supply of ink which, thereby, inhibits the control necessary for precision machines.

Another example of providing a non-smooth surface on the pickup roller is shown in U.S. Pat. No. 3,098,437, issued July 23, 1963, to Tyma, Jr., et al. This patent shows one of various attempts to provide a helical pattern of grooves which define rounded ridges and valleys helically around the surface of the pickup roller. A major problem with such helical configurations is that the pattern of ridges or grooves act as a screw pump. Consequently, the ink tends to move from one ridge to the next ridge, rather than providing a continuous flow of ink from the fountain roller to the transfer roller system.

This invention is directed to solving the above problems by providing a new and improved pickup roller for ink and/or moisture feeding systems.

SUMMARY OF THE INVENTION

An object, therefore, of the invention is to provide a new and improved ink feeding system which incorporates a unique ink or moisture pickup roller.

In the exemplary embodiment of the invention, a feeding system is illustrated in a duplicating machine, such as a rotary offset lithographic duplicating machine. Of course, it should be immediately understood that the invention is equally applicable for other apparatus such as rotary printing presses, or the like. It also should be understood that the novel pickup roller can be used for either an ink or moisture feeding system.

Specifically, the system includes an ink fountain having a fountain roller rotatable in the fountain. A transfer roller is journalled parallel to the fountain roller and spaced therefrom. A pickup roller is journalled parallel to the fountain and transfer rollers, with the surface of the pickup roller in contact with the transfer roller and slightly spaced from the fountain roller for contact with the ink film on the fountain roller.

The pickup roller of this invention is provided with a cylindrical surface formed by a plurality of spaced circular ribs defining a pattern of generally parallel ridges and valleys along the pickup roller normal to the axis of rotation thereof. The ribs may be rounded but other configurations are contemplated.

In the preferred embodiment of the invention, the width of the ribs and the spacing between the ribs are substantially equal. The height of the ribs preferably is less than the width thereof.

Therefore, it can be seen that each rib provides a continuous, endless circular ring which constantly takes ink from the same spot on the fountain roller. Therefore, ink does not translate lengthwise of the roller and better control is provided. This is particularly true when the transfer roller is "soft" or relatively resilient whereby the surface thereof can be impressed slightly by the circular ribs of the pickup roller. In operation, the generally parallel ridges defined by the ribs are the only surfaces of the pickup roller which engage and pick up the ink when the rollers are properly adjusted.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 3 is a perspective view of the ink feeding system of FIG. 3; and

FIG. 4 is a vertical section through the ink fountain, ink fountain roller and pickup roller taken generally along line 4—4 of FIG. 3.

DETAILED DESCRIPTION OF THE PREFERRED EMBODIMENT

Figure 1:
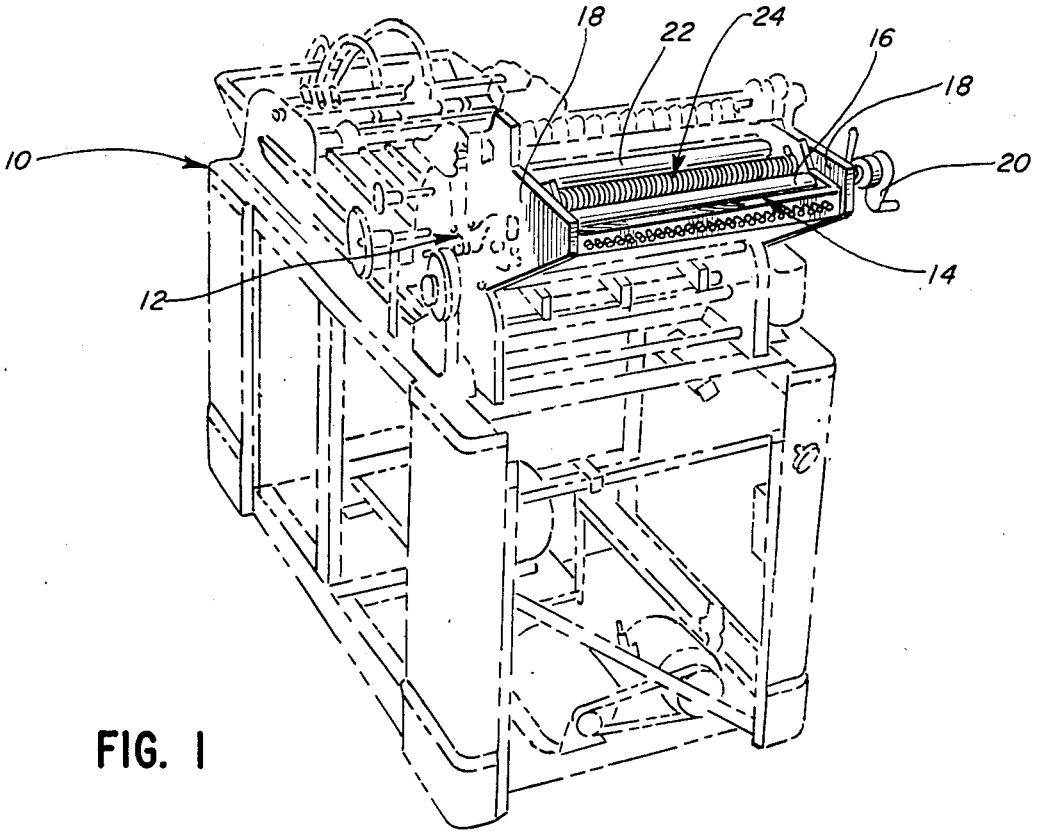
FIG. 1 is a perspective view of a rotary offset lithographic machine, shown in phantom, incorporating an ink feeding system with the ink pickup roller of this invention at the top, rear of the machine.

Referring to the drawings in greater detail, and first to FIG. 1, a conventional rotary offset lithographic duplicating machine is shown in phantom and generally designated 10. The machine has a standard printing couple, generally designated 12, which includes conventional cylinders and rollers for feeding ink through the couple and transferring images to copy sheets. An ink fountain assembly, generally designated 14, is disposed at the head of the printing couple and includes an ink fountain roller 16 disposed between a pair of side braces 18. A crank 20 is provided for manually rotating fountain roller 16 independently of automatic rotation of the fountain roller during operation of the machine. Normally, the fountain roller is incrementally rotated rather than being rotated continuously. The ink feeding system includes a transfer roller 22 journalled between side braces 18 parallel to fountain roller 16 and spaced therefrom. A pickup roller, generally designated 24, according to the invention, is journalled between side braces 18 parallel to fountain roller 16 and transfer roller 22 with the surface of the pickup roller in contact with the transfer roller and slightly spaced from the fountain roller.

It should be understood that the illustration of the invention in conjunction with a rotary offset lithographic duplicating machine is not intended to be limiting. The novel pickup roller is equally applicable for rotary printing presses or the like. It also should be understood that, although the pickup roller is illustrated in conjunction with an ink feeding system, the invention is equally applicable in a moisture feeding system or the like.

Figure 2:
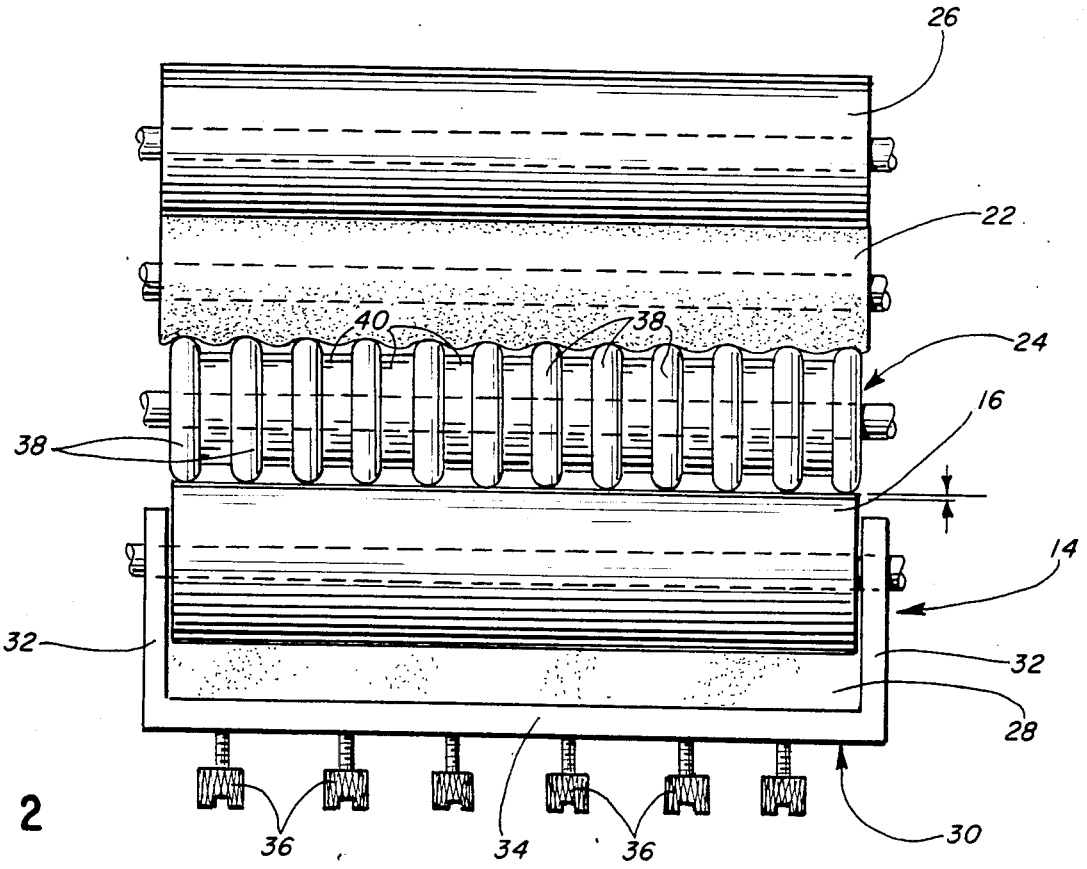
FIG. 2 is a fragmented plan view, on an enlarged scale, showing an ink fountain, ink fountain roller and other transfer rollers in conjunction with the pickup roller of this invention.

FIGS. 2 and 3 better illustrate the ink feeding system described above, including ink fountain assembly 14, fountain roller 16, pickup roller 24 and transfer roller 22. Furthermore, an additional roller 26 is illustrated in contact with transfer roller 22 as part of a system to supply an even and uniform flow of ink to the printing couple of the duplicating machine. It also can be seen that transfer roller 22 preferably is a "soft" roller, i.e. one with a relatively resilient outer surface.

Ink fountain assembly 14 is conventional and includes a fountain trough defined by an elongated blade 28 extending along one side of the trough and ink fountain roller 16 extending along the other side of the trough. The blade and roller are mounted on a frame, generally designated 30, which includes a pair of side plate portions 32 and a front frame portion 34. Blade 28 is secured to the frame by appropriate fasteners. As is known, a plurality of thumb screws 36 are threaded through frame portion 34 whereby the distal ends of the screws angularly abut against the underside of blade 28. By adjusting the thumb screws, a gap between the blade and fountain roller 16 can be varied along the length of the roller to maintain as consistent a thickness of ink as possible to be applied to the fountain roller along the blade.

The invention contemplates forming the pickup surface of pickup roller 24 with a plurality of spaced circular ribs 38 which define a pattern of generally parallel ridges and valleys 40 along the pickup roller normal to the axis of rotation of the roller. As seen in FIG. 2, a preferred ink feeding system includes transfer roller 22 having a resilient surface whereby ribs 38 slightly impress into the surface of the transfer roller when transferring ink thereto.

Exemplary parameters for a pickup roller incorporating circular ribs 38 which has proven effective has been to provide a roller with an outside rib diameter of 1.25 inch, each rib having a width on the order of 0.125 inch, a height on the order of 0.010 inch and spaced to define valleys on the order of 0.125 inch. Generally, these parameters would include the width of the ribs and the spacing between the ribs to be substantially equal, and the height of the ribs to be less than the width of the ribs.

The circular ribbed pickup roller of this invention has proven to supply ink to a transfer roller in a continuous or semi-continuous manner which provides superior flow characteristics than conventional ductor roller systems, thereby eliminating the shadows or lines caused by ductor skidding and bouncing, as well as eliminating the complicated and expensive ducting mechanisms required. Less rollers are required in the system for supplying an even and uniform flow of ink than is required to smooth out the "ducted" ink bands which, again, reduces expenses and lessens complications than a ductor roller system.

In essence, the ribbed roller 24 of this invention can completely eliminate the need for a ductor roller system and its accompanying problems by providing a continuous ink and/or moisture roller system which does not have the disadvantages of a continuous contact surface of conventional continuous roller systems. In other words, referring to FIG. 4, blade 28 of ink fountain assembly 14 is adjusted by thumb screws 36 to define a given gap 40 which determines the thickness of ink film 42 carried by the fountain roller. This ink film is split, as at 44, in any ink feeding system whereby a still thinner film of ink 46 is carried by the pickup roller. With a continuous-contact roller feeding system having a pickup roller with a smooth surface, the thickness of ink film 42 on fountain roller 16 must be very thin in order to maintain any degree of control over the thickness of ink film 46 carried by the pickup roller. Therefore, the very thinness of ink film 42 on the fountain roller results in greatly diminishing the range of control available with a smooth surface, continuous contact pickup roller.

With the ribbed roller of this invention, ink film 42 on fountain roller 16 can be maintained considerably thicker because only ribs 38 come in contact with the ink on the fountain roller and thereby limits the ink split 44 between the fountain and pickup rollers. With the much thicker film 42 on fountain roller 16, a much larger range of adjustment is afforded without significant error. For instance, if ink film 46 is effectively removed by the pickup roller from ink film 42 on fountain roller 16, a continuously running film thickness 48 is maintained about the fountain roller. With a continuous contact, smooth surface pickup roller, the thickness of ink film 48 must be maintained on the order of 0.0001 inch for proper flow control through the ink feeding system. With the ribbed roller 24 of this invention, it has been found that a considerably larger ink film thickness 48 can be maintained on the order of 0.01 inch. Since a considerably larger amount (thickness) of ink is carried by each rib 38 than any given point on a smooth surface roller, it can be seen that a much larger range of adjustments can be made between the fountain roller and the pickup roller to control the ink flow through the feeding system than possibly can be attained with a smooth surface roller.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An ink feeding system for a duplicating machine comprising, in combination, an ink fountain having a fountain roller rotatable in the fountain, a transfer roller journalled parallel to the fountain roller and spaced therefrom, and a pickup roller journalled parallel to the fountain and transfer rollers with the surface of the pickup roller in contact with the transfer roller and slightly spaced from the fountain roller, said surface being formed by a plurality of spaced circular ribs defining a pattern of generally parallel ridges and valleys along the pickup roller normal to the axis thereof, said ribs being on the order of 0.010 inch high and 0.125 inch wide, with the ribs spaced on the order of 0.125 inch.

2. In a duplicating machine as in claim 1, wherein said ribs are rounded.

3. In a duplicating machine as in claim 1, wherein said transfer roller is relatively soft whereby the surface thereof can be impressed slightly by the ribs of the pickup roller.

4. In a duplicating machine which includes an ink fountain having a fountain roller rotatable in the fountain, a transfer roller journalled parallel to the fountain roller and spaced therefrom, and a pickup roller journalled parallel to the fountain and transfer rollers with the surface of the pickup roller in contact with the transfer roller and slightly spaced from the fountain roller, the improvement comprising the surface of the pickup roller being formed by a plurality of spaced circular ribs defining a pattern of generally parallel ridges and valleys along the pickup roller normal to the axis thereof, said ribs being on the order of 0.010 inch high and 0.125 inch wide, with the ribs spaced on the order of 0.125 inch.

5. The improvement of claim 4 wherein said ribs are rounded.

* * * * *